US006285828B1

(12) United States Patent
Cafaro

(10) Patent No.: US 6,285,828 B1
(45) Date of Patent: Sep. 4, 2001

(54) INFRARED HAIR DRYER HEATER

(75) Inventor: Michael Cafaro, El Paso, TX (US)

(73) Assignee: Helen of Troy, El Paso, TX (US)

( * ) Notice: Subject to any disclaimer, the term of this patent is extended or adjusted under 35 U.S.C. 154(b) by 0 days.

(21) Appl. No.: 09/575,992

(22) Filed: May 23, 2000

(51) Int. Cl.[7] ..... A45D 20/00

(52) U.S. Cl. ..... 392/385; 392/410; 34/97; 34/266

(58) Field of Search ..... 392/384, 385, 392/409, 410; 37/96, 97, 266, 267; 607/100, 104, 107, 96

(56) References Cited

U.S. PATENT DOCUMENTS

| | | | | |
|---|---|---|---|---|
| 1,579,513 | * | 4/1926 | Cameron | 34/97 |
| 1,609,412 | * | 12/1926 | Kolisch | 34/96 |
| 1,639,753 | * | 8/1927 | Shelton | 392/383 |
| 1,659,780 | * | 2/1928 | Meyer | 34/96 |
| 1,660,802 | * | 2/1928 | Martin | 34/97 |
| 1,669,569 | * | 5/1928 | Meyer | 34/96 |
| 1,686,024 | * | 10/1928 | Meyer | 34/97 |
| 1,781,879 | * | 11/1930 | Norden | 392/383 |
| 1,785,418 | * | 12/1930 | Meyer | 34/96 |
| 3,289,679 | * | 12/1966 | Zellerman | 34/97 |
| 4,263,500 | | 4/1981 | Springer et al. . | |
| 4,323,761 | | 4/1982 | Hubner . | |
| 4,382,174 | | 5/1983 | Barns . | |
| 4,395,619 | | 7/1983 | Harigai . | |
| 4,595,838 | | 6/1986 | Kerschgens . | |
| 4,602,143 | | 7/1986 | Mack et al. . | |
| 4,910,382 | | 3/1990 | Kakuya et al. . | |
| 6,053,180 | * | 4/2000 | Kwan | 132/232 |
| 6,205,677 | * | 3/2001 | Yune | 34/266 |

FOREIGN PATENT DOCUMENTS

| | | | |
|---|---|---|---|
| 2950001 | * | 6/1981 | (DE) . |
| 1522777 | * | 8/1978 | (GB) . |
| 3-224504 | * | 10/1991 | (JP) . |
| 6-125810 | * | 5/1994 | (JP) . |

* cited by examiner

*Primary Examiner*—John A. Jeffery
(74) *Attorney, Agent, or Firm*—John E. Toupal; Harold G. Jarcho

(57) ABSTRACT

A hair dryer having both a fan-forced convection heater and radiant heater which emits energy having wavelengths in both the infrared and visible spectrum. The housing of the dryer is translucent to visible light but absorbent of infrared radiation and arranged to facilitate the transfer of heat generated by the absorption of the infrared radiation into the fan-forced airflow. The visible light emanating from the dryer provides an indicator of the dryer's operation and a warning of the presence of the otherwise invisible and otherwise dangerous infrared radiation.

8 Claims, 5 Drawing Sheets

INFRARED HAIR DRYER HEATER

BACKGROUND OF THE INVENTION

The present invention relates to hair dryers and, more particularly, to a hair dryer having a heating source that emits heat and light having wavelengths in the visible spectrum.

When hair is wet, it becomes densely packed. As such, it is difficult for heat to penetrate wet hair to dry it. Ironically, hair that is wettest is most inefficient to dry through conventional means.

Traditional hair drying systems that rely on fan-forced convection heat are unable to get heat into the underlying hair fibers within tresses of densely packed wet hair. It is a well known and documented problem that hair dryers often damage the outermost hair fibers before the inner fibers are even dry. This damage is caused by the over heating and over drying effects of hot air.

Several attempts have been made to increase the rate at which under-lying wet hair is dried. These include coupling of the dryer to a brush or comb attachment that mechanically separates the hair fibers as hot air is blown at the hair. Various hot air injection attachments have also been devised for blow dryers in an attempt to address this problem, which include hollow tines that feed hot air directly into the wet tresses. In general, these attachments and accessories have improved the problem, but caused the hair dryer to be more complicated than desired in both design and use, and rendered the hair dryer more specifically dedicated to a particular hair style, which reduced its versatility and value. Also, the physical disturbance of the hair tresses by such attachments and accessories tend to "fluff" the hair and provide a style that may not be desirable.

Additional attempts to heat and dry the underlying hair fibers with infrared heat have been made with limited success. Although the infrared rays do penetrate the wet hair tresses more effectively and dry the hair more efficiently, excessive exposure to infrared rays can be damaging to the skin, scalp, and hair follicles, and its invisibility does not provide for a very effective indicator of its presence. It is found that users do not respect the danger of invisible infrared heat until they feel the heating of the scalp, after the hair is already damaged and the scalp has been overexposed.

SUMMARY OF THE INVENTION

The present invention alleviates to a great extent the disadvantages of the hair dryers of the prior art by providing a hair dryer including a traditional fan-forced heating system which is enhanced with light radiant heat having wavelengths in the infrared and visible spectrum, respectively. It is found that the coupling of visible light with infrared radiation is as effective in heating and drying the underlying fibers of wet hair as is purely invisible infrared radiation, while providing the user with an obvious indicator of the invisible infrared radiation's otherwise dangerous presence. It is further found that use of such a combined heating system results in less damage to the hair and skin, which is most likely the result of the added caution a user employs in the presence of heat with visible light.

OBJECTS OF THE INVENTION

It is an object of the present invention to provide an improved hair dryer.

It is another object to provide an improved hair dryer that can thoroughly dry densely packed wet hair.

It is another object to provide such an improved hair dryer that can thoroughly dry such densely packed wet hair without damaging the hair or scalp.

It is another object to provide such an improved hair dryer that can be easily used without the attachment of accessories or use of auxiliary devices.

It is another object to provide an improved hair dryer with the foregoing advantages and that is less likely to disrupt the hair during drying.

It is a further object to provide an improved hair dryer which emits heat that is coupled to visible light to provide an indicator of the heat's presence prior to the sensation of a temperature rise on the scalp.

Other objects and advantages of the present invention will be readily apparent from the following description and drawings, which illustrate two embodiments of the invention.

DETAILED DESCRIPTION OF THE PREFERRED EMBODIMENT

Figure 1:
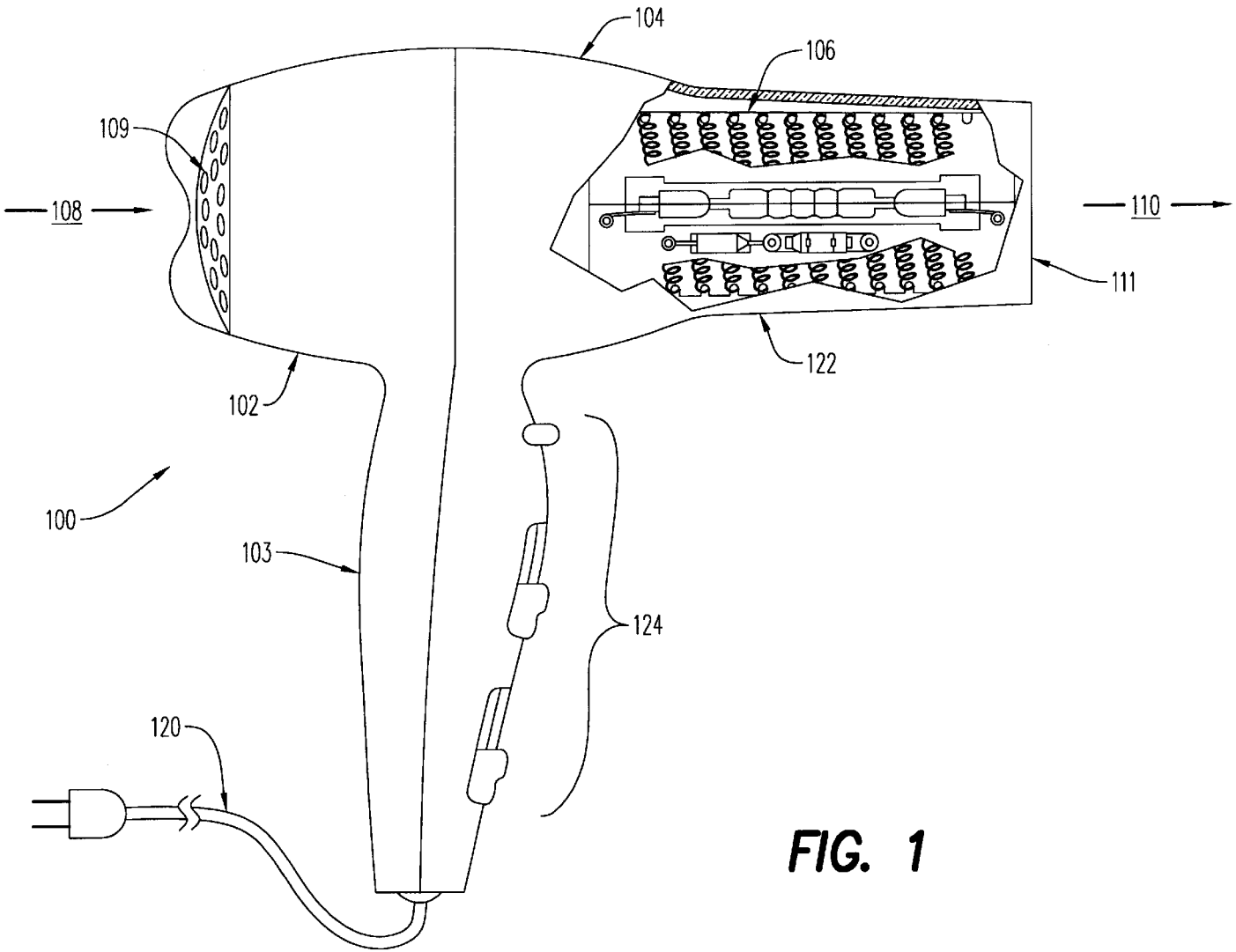
FIG. 1 is a partially sectioned side view of the preferred embodiment of a hair dryer in accordance with the present invention.

FIGS. 1 through 4 depict the first preferred embodiment of a hair dryer in accordance with the present invention. Hair dryer 100 includes a housing 102 that comprises a handle portion 103 and a head portion 104. The head portion encloses a blower 105 for forcing air through the head portion and a heater 106 for heating that air as it passes through the head portion.

Ambient air 108 is pulled into the head portion at intake vent 109 by the blower, forced over the heater where it becomes heated, and is exhausted as hot air 110 through the exhaust opening 111.

Figure 3:
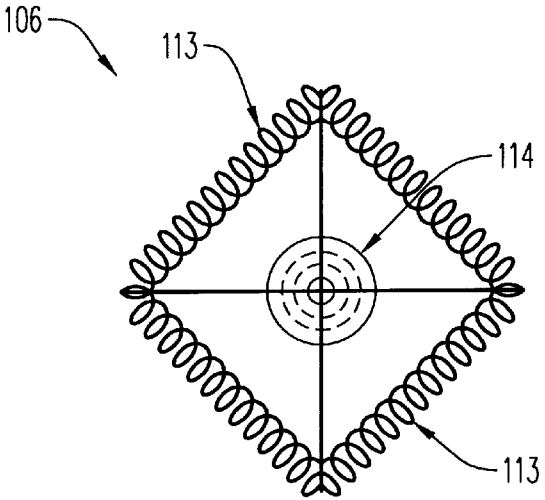
FIG. 3 is an end view of the heater of the hair dryer of FIG. 1.
Figure 2:
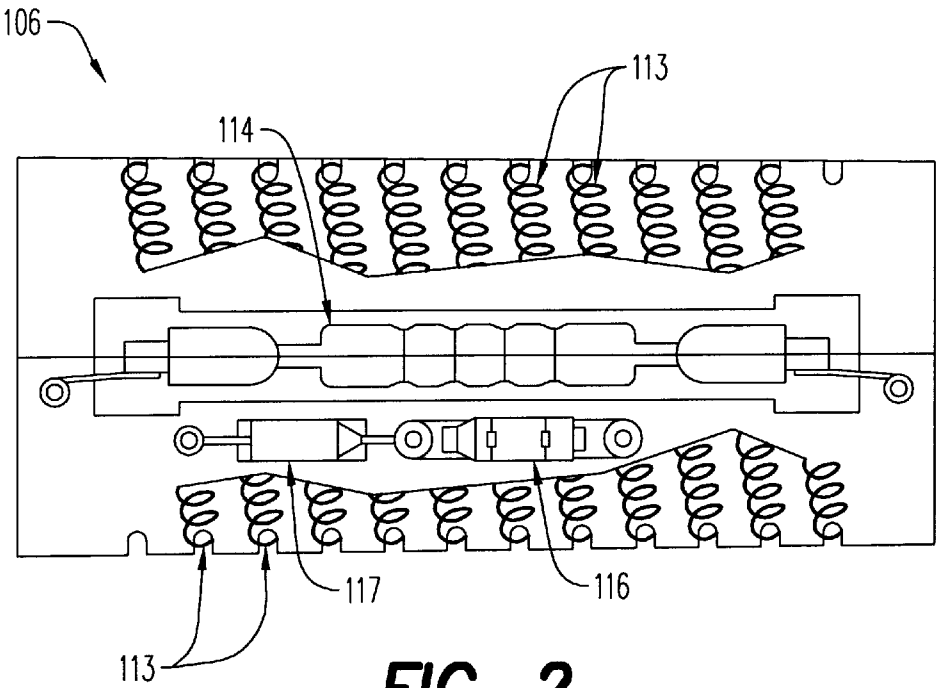
FIG. 2 is a side view of the heater of the hair dryer of FIG. 1.

The heater, best viewed in FIGS. 2 and 3, includes both a convection heating element comprising a number of electric heating coils 113 and a radiant heating element comprising a 150 Watt halogen lamp 114. When energized, the lamp emits both visible light, having wavelengths between 400 and 750 nanometers, and infrared radiation, having wavelengths between 1 millimeter and 1 micrometer. As such, this emission transcends both the infrared and visible spectrum.

Also included in the heater are a thermostat 116, to energize the heater whenever the air temperature within head portion is below a pre-selected value, and a thermal fuse 117, to disable the heater in the event that an abnormally high internal temperature is sensed.

Both the blower and the heater are powered by electric current, such as household alternating current from a 120

VAC source 119, supplied through a power cord 120. The blower, electrical connections of the various components, associated wires and certain electronic circuit components may be similar to the existing art and are therefore not shown for clarity, except schematically in FIG. 4.

The housing's head portion includes a tubular duct 122, which surrounds the heater to force the flowing air therethrough and which directs the heated airflow 110 out through the exhaust opening 111. The duct is comprised of a translucent material that allows only the visible light emanating from the halogen lamp to glow through. This provides the benefits that a user can instantly recognize when the heater is energized without the loss of valuable infrared light, and that this visible glowing of the head, which comprises the dryer's hot components, serves as an indicator to warn the user where not to grasp the dryer.

The housing's handle is equipped with a switch arrangement 124 which allows the user to select a variety of air flow and temperature settings as later described.

In operation, the dryer's exhaust opening 111 is aimed towards wet hair such as around a curling roller. With the heater energized, hot air 110 is directed toward the wet hair and both light and infrared radiation are emitted longitudinally from the halogen lamp towards the hair. That light and radiation exiting the lamp radially impinges the tubular duct, where the longer wavelength infrared radiation is absorbed while the shorter wavelength visible light is passed. In this unique arrangement, the heat created by the absorption of the radially emitted infrared radiation is efficiently captured at the wall of the tubular duct and transferred into the passing air flow so that it is directed toward the hair, while only the visible light is emitted radially from the dryer to serve the indicating and warning functions previously described.

Figure 4:
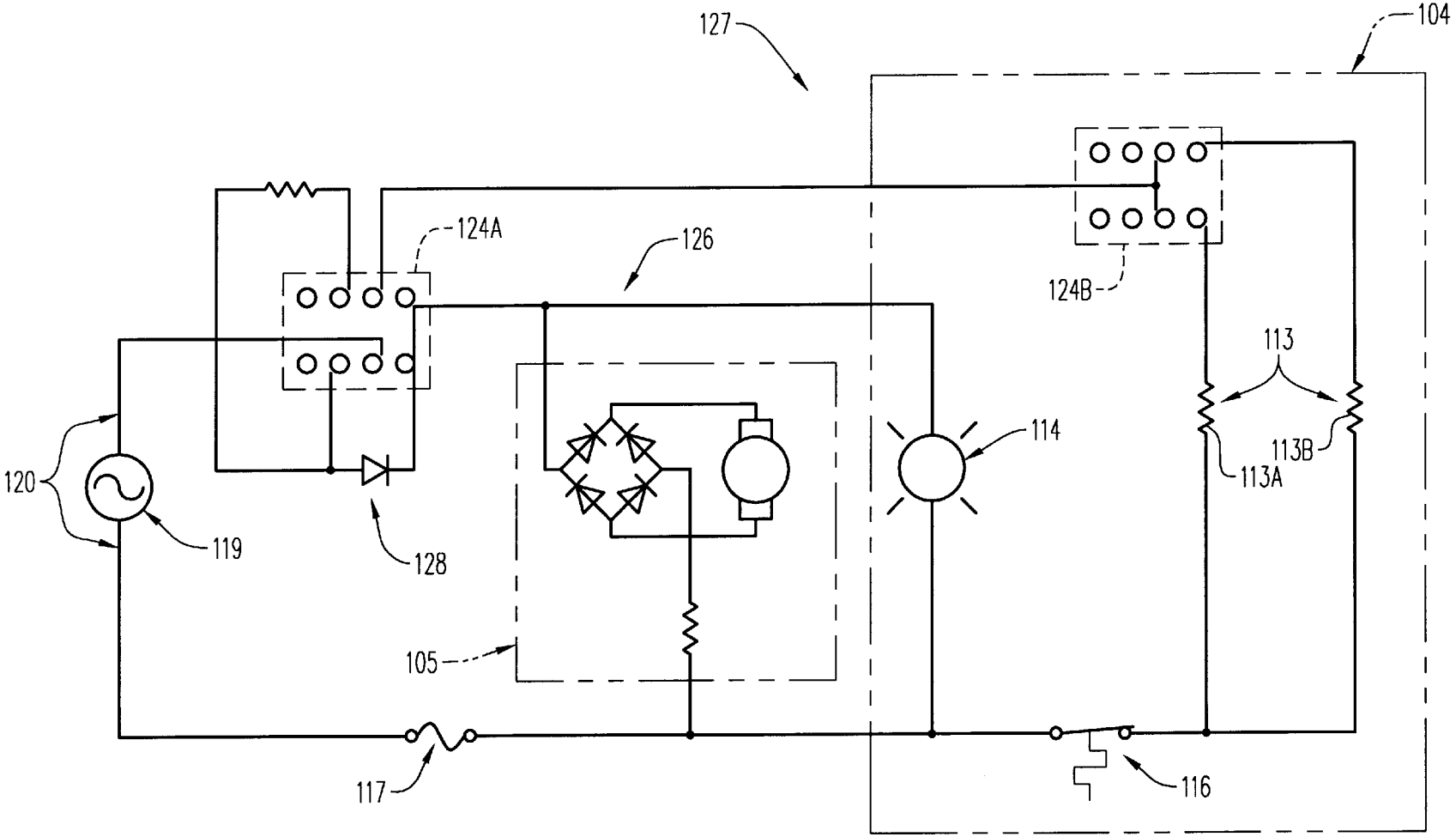
FIG. 4 is a schematic diagram of the electric circuitry of the hair dryer of FIG. 1.

FIG. 4 depicts the electrical circuitry of the first embodiment. It will be noted that certain components shown, such as the blower 105, switch arrangement 124 comprising mode switch 124A and temperature switch 124B, thermostat 116, convection heater 113, halogen lamp 114, and thermal fuse 117, are those already described and physically mounted according to the prior description, being shown only schematically in this diagram.

The circuit is provided with power from a standard 120 VAC supply 119. Mode switch 124A is adatped in the "high" position for providing that 120 VAC directly to the blower/lamp subcircuit 126 and to the heating subcircuit 127. In the "low" position, power is routed through a diode 128, which reduces the blower speed. Temperature switch 124B allows the selection of either full power from the convection heater 113, by connecting either both heating coils 113A and 113B when in the "high" position, or only the low-power coil 113B when in the "low" position.

In operation, the blower 105 is energized to force air through tubular duct, past the energized convection heater and halogen lamp, where it is heated. The blower also serves to circulate the heated air over the thermostat 116 and thermal fuse 117.

Figure 5:
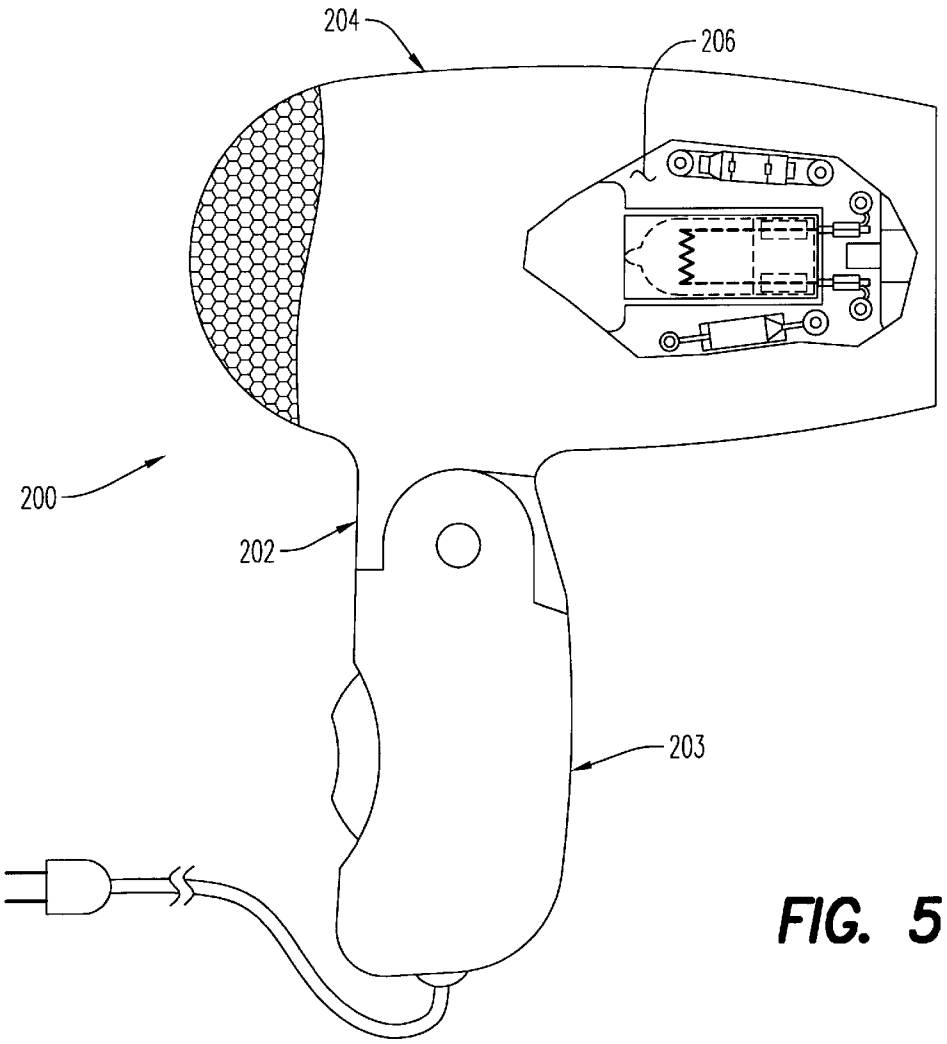
FIG. 5 is a partially sectioned side view of a second embodiment of a hair dryer in accordance with the present invention.
Figure 7:
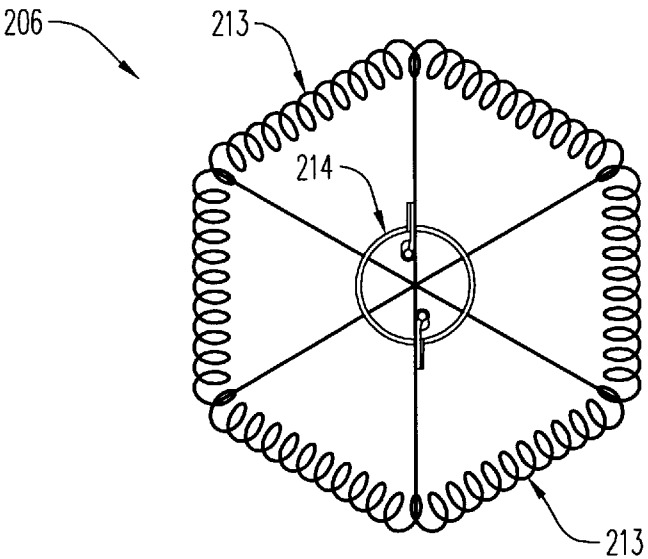
FIG. 7 is an end view of the heater of the hair dryer of FIG. 5.
Figure 6:
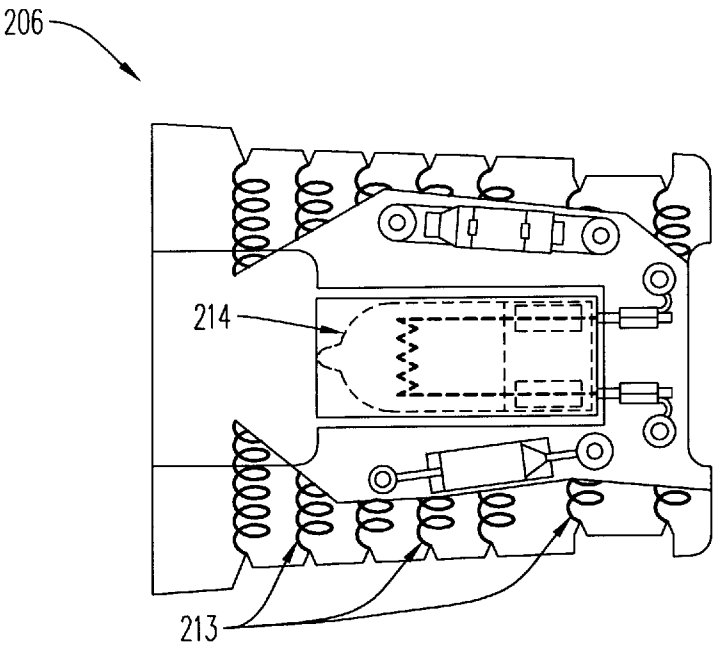
FIG. 6 is a side view of the heater of the hair dryer of FIG. 5.

A second embodiment 200 of the invention is depicted in FIGS. 5 through 7. In this embodiment, housing 202 is formed by the hinged connection of handle portion 203 and head portion 204 to provide for the folding and more compact packaging and storing of the dryer. Similar to the first embodiment, heater 206 is comprised of both a convection heating element comprising a number of electric heating coils 213 and a radiant heating element comprising halogen lamp 214. Other aspects of this embodiment are identical to those already described.

It should be understood that the above are descriptions of the preferred embodiments of the invention and, as such, are merely representative of the invention but not exclusive of other embodiments which may fall within the spirit of the invention. Therefore, the scope of the invention should only be limited by the following claims.

What is claimed is:

1. A hair dryer comprising:

a convection heater for providing a current of air;

a radiant heater for emitting energy having wavelengths in both the infrared and visible spectrum;

a tubular duct surrounding said radiant heater, said duct being substantially translucent to energy having wavelengths in the visible spectrum and substantially opaque to energy having wavelengths substantially in the infrared spectrum; and a blower for forcing said current of air past said convection and radiant heaters, whereby said current of air is heated and exhausted from said hair dryer.

2. A hair dryer as in claim 1 wherein said hair dryer is a portable hand-held hair dryer and said radiant heater is a halogen lamp.

3. A hair dryer as in claim 1 wherein said convection heater comprises a plurality of heating coils.

4. A hair dryer as in claim 3 further comprising thermostatic control means for sensing the temperature within said hair dryer and for enabling one of said heaters when said temperature is below a given level and for disabling said one of said heaters when said temperature is above said given level.

5. A hair dryer as in claim 1 further comprising thermostatic control means for sensing the temperature within said hair dryer and for enabling both of said heaters when said temperature is below a given level and for disabling both of said heaters when said temperature is above said given level.

6. A hair dryer as in claim 1 further comprising a housing having a tubular duct surrounding said convection heater and adapted to direct said current of air substantially through said convection heater whereby said current of air is heated.

7. A hair dryer comprising:

a blower for generating a current of air;

a convection heater having a plurality of heating coils;

a halogen lamp adapted for emitting visible light and infrared energy; and a housing having an exhaust opening and a tubular duct surrounding both said convection heater and said lamp, said duct being adapted to direct said current of air substantially through said convection heater wherein said current of air is heated, said duct being substantially opaque to said infrared energy such that said radiant energy is retained within said duct, and said duct being substantially translucent to said visible light, and whereby said visible light is emitted through said duct and said exhaust opening, and substantially all of said heated air and said retained infrared energy are exhausted through said exhaust opening.

8. A hair dryer as in claim 3 wherein said plurality of heating coils is adapted for selective energization to provide heat to said current of air at low or high levels.

* * * * *